United States Patent [19]

Flowers

[11] Patent Number: 4,986,785

[45] Date of Patent: Jan. 22, 1991

[54] LIFELINE STRAP APPARATUS

[76] Inventor: Nyal K. Flowers, P.O. Box 14, Bridgeton, N.C. 28515

[21] Appl. No.: 441,294

[22] Filed: Nov. 27, 1989

[51] Int. Cl.[5] ..... B63C 9/26

[52] U.S. Cl. ..... 441/084

[58] Field of Search ..... 441/80, 84, 136; 114/362, 364

[56] References Cited

U.S. PATENT DOCUMENTS

| | | | |
|---|---|---|---|
| 1,080,462 | 12/1913 | Kupfer | 441/84 |
| 2,330,470 | 1/1941 | Calahan | 182/70 |
| 2,651,789 | 9/1952 | Newland | 114/362 |
| 2,975,858 | 4/1958 | Billingsley | 114/362 |
| 3,018,494 | 1/1962 | Guido | 441/84 |
| 3,216,030 | 11/1965 | Garfield | 441/84 |
| 4,661,077 | 4/1987 | Griffith et al. | 441/84 |
| 4,721,487 | 1/1988 | Cochran | 441/84 |

*Primary Examiner*—Joseph F. Peters, Jr.
*Assistant Examiner*—Jesûs D. Sotelo
*Attorney, Agent, or Firm*—Dowell & Dowell

[57] ABSTRACT

A small boat safety lifeline apparatus includes one or more straps, each having an end connected just inside at the upper edge or gunwale of the boat and stored for use in a coil having a readily releasable holder, the other end of the strap having a loop adapted to be tossed over the capsized or partially submerged boat and placed around the body of a person beneath his armpits, the person being partially submerged in water outside of the boat. The loop has a buckle or the like so that it may be adjusted around the person and the distance from the boat adjusted so that the boat lifts the strap and the strap has a combined lifting and holding action on the person in order to prevent the person from drowning.

11 Claims, 3 Drawing Sheets

FIG. 6
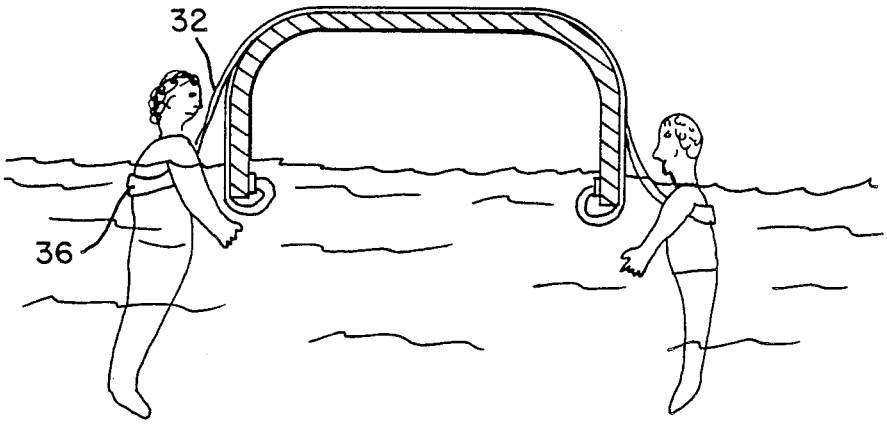
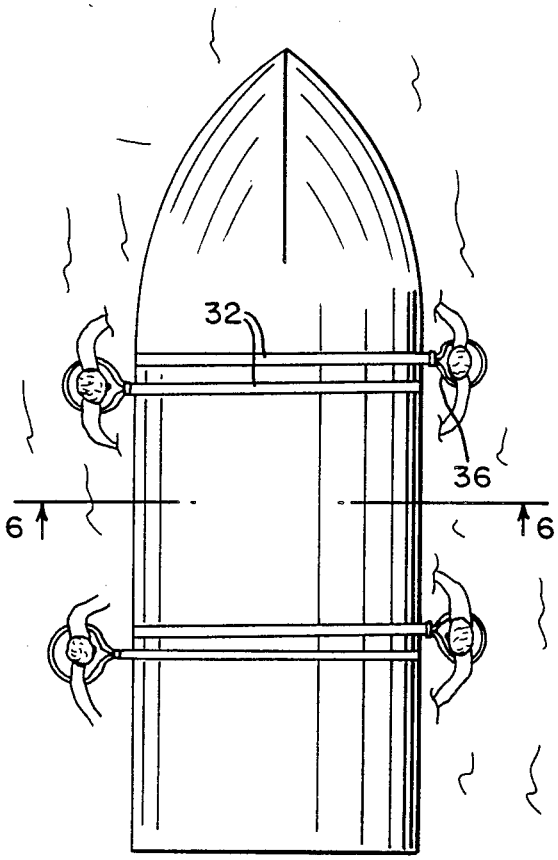
FIG. 5

FIG. 8
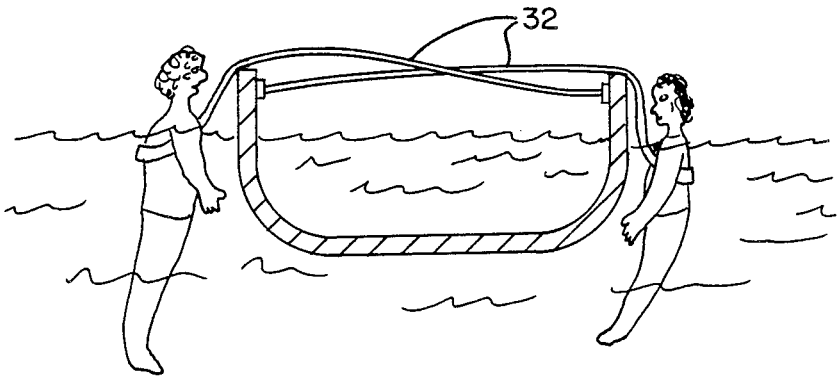
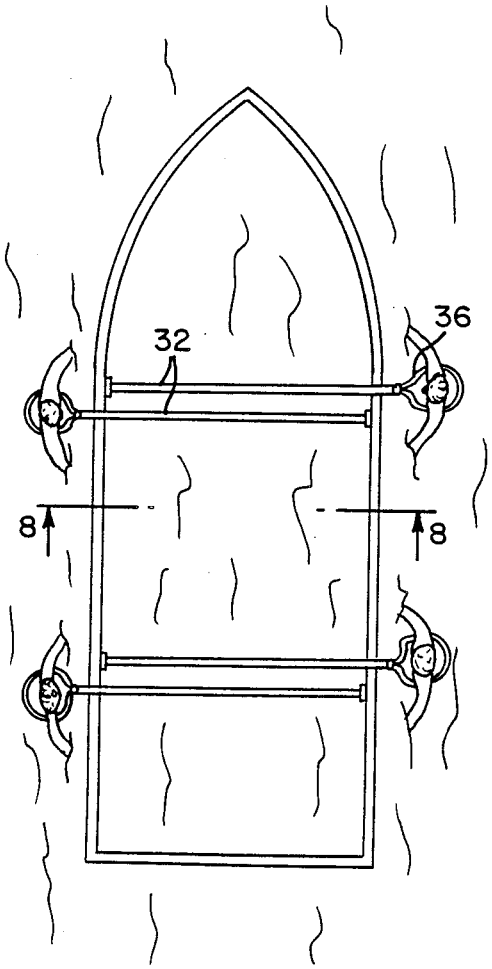
FIG. 7

LIFELINE STRAP APPARATUS

BACKGROUND OF THE INVENTION

The capsizing or taking on water of relatively small boats continues to be a leading cause of death by drowning. Various life saving devices have been tried such as buoyant articles circular life preservers, and life vests but these have only been partially successful due to the fact that they have not provided the user with any relatively stable means of remaining afloat with his head above water nor of keeping the user with the boat.

When a relatively small boat is capsized or takes on appreciable water, its reduced buoyancy may h=such that if the occupants remain in or on the boat they and the boat will sink.

However, if the occupants get into the water its buoyant effect reduces their net weight so that even the reduced buoyancy of the boat may be adequate to keep them from drowning.

Further, in making a search for survivors of a boating accident it is usually much easier to locate the boat than it is to locate individual survivors. A person in the water, however, may not be able to hold on to a capsized or submerged boat, particularly over a length of time, so that he is likely to become separated from the boat.

FIELD OF THE INVENTION

The present invention relates to lifeline safety apparatus and more particularly to a lifeline strap system by means of which one or more persons in the water adjacent to a boat may be attached to the boat in a manner to take advantage of its buoyancy which, when added to the buoyancy of the person in the water, is sufficient to prevent drowning.

DESCRIPTION OF THE RELATED ART

The U.S. Pat. No. 3,216,030 to Garfield, discloses a boat having a series of coils of rope connected at one end inside the gunwale of the boat, the rope having a spaced series of coils sewn along its length and being attachable at its ends to the sides of the boat. In use survivors grab the fixed coils or place their arms or legs through them in an effort to support themselves on the bottom of the boat.

The U.S. Pat. No. 3,018,494 to Guido, discloses a chain which is wrapped around the waist of a boat occupant so that in the event that he is lost overboard he may pull in on the chain to get back onto the boat.

The U.S. Pat. No. 4,661,077 to Griffith, et al, discloses a rope in which a loop is formed by passing through a resilient floatable member in order that a person may place the loop over his body.

The United States Patent to Kupfer discloses an apparatus in which a person may be suspended in order to practice swimming without being in the water.

The U.S. Pat. No. 2,330,470 to Calahan, discloses a heaving line device having a weight at one end which is connected to a strap that is doubled over on itself numerous times for storage.

The U.S. Pat. No. 2,651,789 to Newland, discloses a boat lifeline in which a rope is attached beneath the gunwale of a boat and a stirrup extends downwardly over the side.

The U.S. Pat. No. 2,975,858 to Billingsley, discloses a boat stirrup that is connected by a strap to the side of the boat to facilitate a person climbing onto the boat.

SUMMARY OF THE INVENTION

The present invention recognizes and takes advantage of the fact that a partially submerged or a capsized boat may still retain a measure of buoyancy which may be sufficient, when added to the buoyancy of persons in the water, to maintain the persons afloat with their heads above water, thereby preventing drowning. At the same time, the apparatus maintains a secure hold on the body of the person using it, thereby causing the person to remain afloat near the boat and thus avoid drowning even though the person may be unable to function to keep himself afloat otherwise, due to fatigue, lack of consciousness, or inclement weather.

The invention is particularly suited for use with small boats, open or cabin type, typically from about twelve to thirty feet in length. The boat must be constructed to remain afloat when capsized, swamped or flooded. Such boats are well-known, and may be constructed of various materials such as fiberglass, aluminum or wood.

Accordingly, it is an object of the invention to provide a lifeline apparatus system for a relatively small boat which, in use, keeps the persons afloat in a life saving position in proximity to the boat thereby facilitating their rescue.

A further object of the invention is a provision of a boat safety lifeline apparatus which is adaptable for use on varieties of small crafts and which may be used to supplement conventional life saving equipment such as flotation gear.

The invention is embodied in one or more straps each of which has one end connected just inside the side of a boat, approximately at the gunwale, and which has at its other end a loop formed by means of a buckle, the strap being coiled for storage and of such length that in case the boat capsizes or takes on excessive water the coil may be released and the loop tossed over the bottom or the top of the boat, as the case may be, to the other side where the loop may be placed around the body of a person in the water and adjusted so that the boat exerts a buoyant effect to lift the loop upwardly thereby providing increased buoyancy for the partially submerged person and keeping him in proximity to the boat until rescue can occur.

BRIEF DESCRIPTION OF THE DRAWINGS

FIG. 5 is a plan view of an overturned boat illustrating the manner of use of the invention;

FIG. 6 is a section on the lines 6—6 of FIG. 5;

FIG. 7 is a plan view of an upright partially submerged boat illustrating an alternative manner of use of the invention; and FIG. 8 is a section of line 8—8 of FIG. 7.

Figure 1:
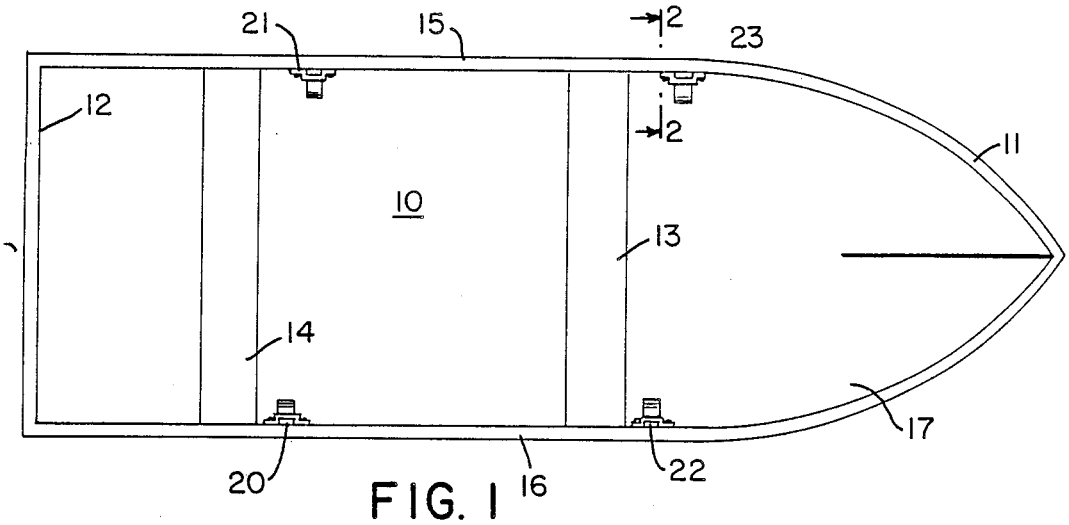
FIG. 1 is a top plan view of a representative and conventional small boat illustrating one manner of mounting lifeline apparatus in accordance with the present invention.

With further reference to the drawings, a boat 10 is illustrated having a bow section 11 and a stern 12 and seats 13 and 14. Along the sides the boat has port and starboard rails or gunwales 15 and 16. The boat is of the relatively small type which is used for fishing and other kinds of recreation. It has a hull 17 which provides a space for passengers and supplies. Should the boat capsize as indicated in FIGS. 5 and 6, or become partially filled with water as in FIGS. 7 and 8, its structure is such that it still retains a measure of buoyancy which is sufficient to keep its former occupants afloat sufficiently to prevent drowning in accordance with the present invention.

Lifeline apparatus in accordance with the present invention is provided at spaced locations 20 and 21, generally opposite but slightly offset from each other and at 22 and 23 generally opposite each other, at different portions of the boat. These are positioned preferably at points along the hull so that if the boat is capsized or takes on water the straps will be supported at positions of maximum buoyancy of the boat.

Figure 2:
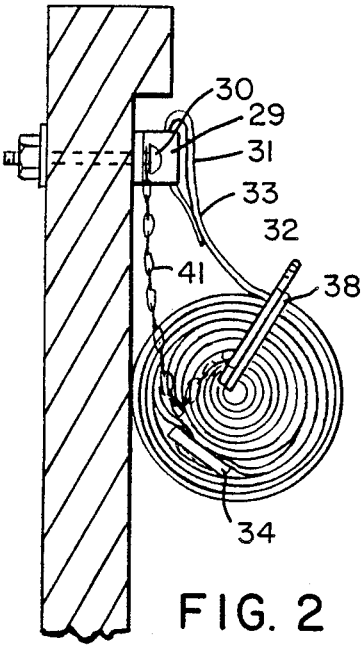
FIG. 2 is a section to an enlarged scale, through the gunwale of the boat of FIG. 1, on the line 2—2, showing an end elevation of one of the coils in accordance with the present invention.
Figure 4:
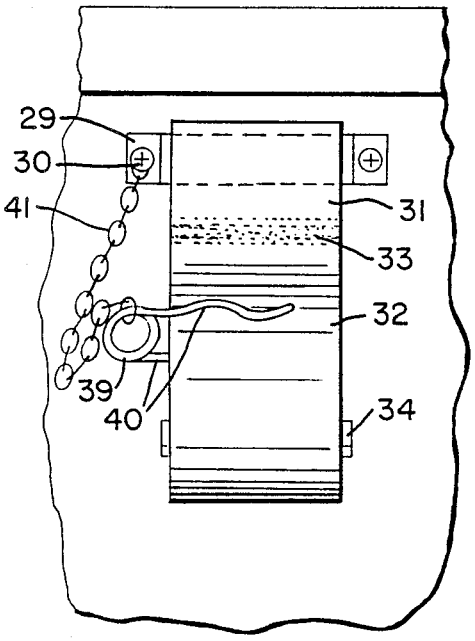
FIG. 4 is a side elevation of the coil of FIG. 2.
Figure 3:
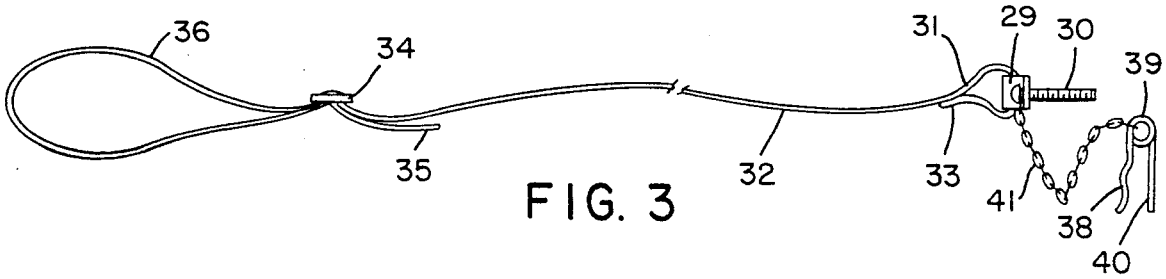
FIG. 3 illustrates the coil of FIG. 2 in extended position.

With particular reference to FIGS. 2, 3 and 4, each coil apparatus includes a bracket 29 which is fastened by suitable means 30 to or just beneath the gunwale of the boat. An end loop 31 of strap 32 is engaged around the bracket and sewn to the strap at 33. The strap is preferably highly light reflective, as an added safety feature At the other end of the strap a buckle 34 is provided along the length of the strap and through which the free end 35 is inserted to provide a loop 36 which a person may place around himself, preferably just beneath the armpits.

In order to hold the coil in a coiled position for ready use a hitch clip 38 is provided having an eye 39 and legs 40 which are inserted within and along the outside of the coil in order to maintain it coiled until needed. The hitch pin is preferably attached by a line such as stainless steel chain 41 to the bracket 30.

The length of the strap is such that when it is passed over the bottom of the boat as shown in FIGS. 5 and 6 or over the top of it as shown in FIGS. 7 and 8, the loop portion is on the opposite side for use by a person in the water on that side. Such person then adjusts the loop around his body as tight as desired, preferably just beneath the armpits, and at the same time adjusts the distance of himself to the boat in order that he may receive a lifting effect from the boat as indicated in FIGS. 6 and 8, with his head and the uppermost portion of his body out of the water.

In use, in the event that the boat capsizes or takes on an excess amount of water, the previous occupants who are in the water alongside of the boat each reach beneath the gunwale and remove a hitch pin to free a loop and then toss the loop to a person on the opposite side of the boat. This permits each such person receiving a loop to place the loop around himself and adjust the loop as previously described in order that he may be held in a position close to the boat and at the same time be lifted by its buoyancy, thereby avoiding drowning. The offset positioning of the coils reduces the likelihood of opposing straps interfering with each other. Their light reflectiveness facilitates their use at low light levels and enhances the possibility of the boat's being spotted after foundering.

I claim:

1. Lifeline strap apparatus for use with a capsized or partially submerged boat, comprising a strap of a length to pass laterally over the bottom or top of the boat and provide a loop to encircle the body of a person in the water, means for securing one end of the strap along the side of the boat, means at the other end of the strap to form an adjustable loop for encircling the body of the person, and for adjusting the distance of the person to the boat to obtain a lifting force by the boat through the strap to the person, and means for holding the strap in coiled position, said means being releasable in order to free the strap so that the loop may be tossed across the boat for use by a person on the other side of the boat.

2. The invention of claim 1, in which the strap adjustment means is a buckle.

3. The invention of claim 2, in which the means for holding the strap in coiled position is a hitch clip.

4. The invention of claim 1, in which the means for holding the strap in coiled position is a clip means.

5. The invention of claim 1, in which straps are mounted on opposite sides of the boat.

6. The invention of claim 1, in which the straps are mounted on the gunwales of the boat.

7. The invention of claim 1, in which a plurality of straps are mounted on opposite sides of a boat in spaced relation and in proximity to the portions of the boat having maximum buoyancy.

8. The invention of claim 1, in which the strap is light reflective.

9. The invention of claim 1, in which the means for securing one end of the strap within the boat is a bracket fastened at its ends to the boat and having a central portion to which an end of the strap is attached.

10. The invention of claim 8, in which the means for holding the strap in coiled position is a clip means, and a line connecting said clip means to the bracket.

11. The method of sustaining buoyancy of a person overboard of a capsized or untenably submerged boat, comprising mounting one end of a coiled strap on one side of a boat, providing an adjustable loop in the other end of the strap, the strap being of a length exceeding the distance across the bottom of the capsized boat from gunwale to gunwale such that the person may engage himself in the loop with the lower portion of his body submerged, the strap engagement with the boat providing a lifting force to keep enough of the upper portion of his body out of the water to avoid drowning, comprising, when the boat capsizes or takes on excess water, uncoiling the strap, tossing the end with the loop across the boat, engaging a person in said loop, and adjusting the length of the loop around the person and the length of the loop from the boat so that the boat provides a lifting force on the person.

* * * * *